US006686525B1

(12) United States Patent
Wu

(10) Patent No.: US 6,686,525 B1
(45) Date of Patent: Feb. 3, 2004

(54) SAXOPHONE MOUTHPIECE

(76) Inventor: Chia-Hsiang Wu, PO Box 82-144, Taipei (TW)

( * ) Notice: Subject to any disclaimer, the term of this patent is extended or adjusted under 35 U.S.C. 154(b) by 0 days.

(21) Appl. No.: 10/394,235

(22) Filed: Mar. 24, 2003

(51) Int. Cl.[7] ..... G10D 9/02
(52) U.S. Cl. ..... 84/383 R
(58) Field of Search ..... 84/383 R, 383 A, 84/385 R, 385 A, 380 A, 387 R

(56) References Cited

U.S. PATENT DOCUMENTS 5,018,425 A * 5/1991 Rovner ..... 84/383 R
5,192,821 A * 3/1993 Goldstein et al. ..... 84/383 R
5,456,152 A * 10/1995 Cusack et al. ..... 84/383 R

* cited by examiner

*Primary Examiner*—Kimberly Lockett
(74) *Attorney, Agent, or Firm*—Leong C. Lei

(57) ABSTRACT

A saxophone mouthpiece, made in one piece, is comprised of a reed indicating a mild slope rising in arc backwards; a middle section receiving the reed and having its outer circumference indicating an approximately conic shape and a tail in a diameter smaller than that of the middle section being adapted to a crook of the saxophone; and an air duct penetrating inside the mouthpiece characterized by that the reed having a mild expansion from both sides of the reed at where it meets the middle section to provide closer contact of lips of its player with both sides of the reed when the mouthpiece is held in the mouth of the player for allowing easier and more concentrated playing.

1 Claim, 4 Drawing Sheets

SAXOPHONE MOUTHPIECE

BACKGROUND OF THE INVENTION (a) Field of the Invention The present invention is related to a saxophone mouthpiece, and more particularly, to one allows easier and more concentrated playing of the instrument by providing closer contact of lips of the player with both sides at where the reed meets the middle section of the mouthpiece.

(b) Description of the Prior Art

As illustrated in FIGS. 1 through 4 of the accompanying drawings, the prior art of a saxophone mouthpiece (10) is comprised of a reed (11), a middle section (12), and a tail (13); the reed (11) indicating a mild slope rising in arc backwards to the middle section (12); the middle section (12) receiving the reed (11) and having its outer circumference indicating an approximately conic shape; the tail (13) in a diameter smaller than that of the middle section being adapted to a crook of the saxophone; and an air duct (14) penetrating inside the mouthpiece. Both sides of the reed (11) by following the middle section (12) reduce to form a taper. Accordingly, when the mouthpiece (10) is held in the mouth of the player, both sides of the reed (11) fails to secure a close contact with the lips, resulting in air leak. The player has to exercise extra holding force of his lips to seal up the reed (11) by compromising a full attention on playing. The beginners usually are suffering slow progress or are forced to give up.

SUMMARY OF THE INVENTION

The primary purpose of the present invention is to provide an improved structure of a saxophone mouthpiece that is ergonomics compliance by having mild expansion of both sides of its reed at where it meets a middle section of the mouthpiece to provide closer contact of the lips of the player with the reed when the mouthpiece is held in his mouth, thus to allow an easier and fully concentrated playing of the saxophone.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
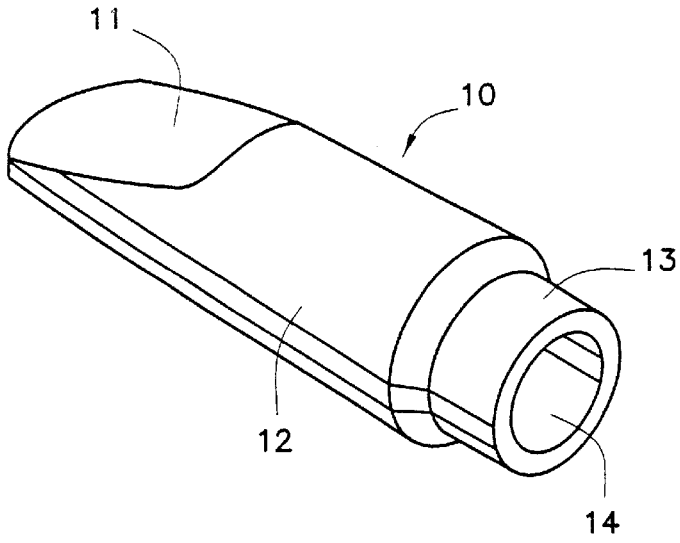
PRIOR ART FIG. 1
FIG. 1 is a perspective view of the prior art.
Figure 2:
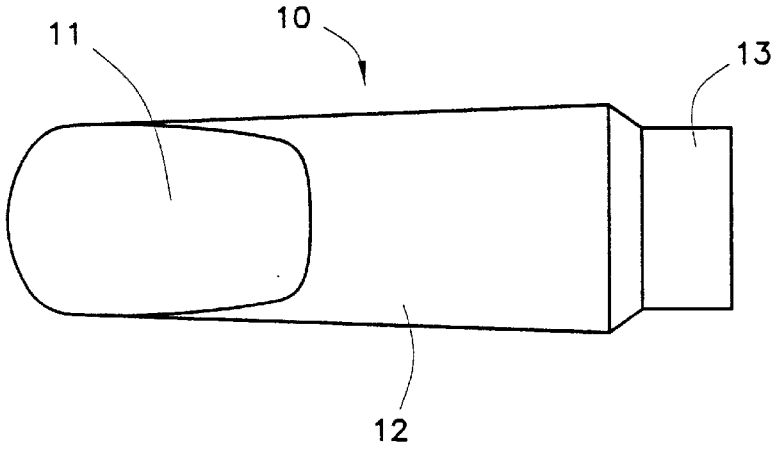
PRIOR ART FIG. 2
FIG. 2 is a top view of the prior art.
Figure 3:
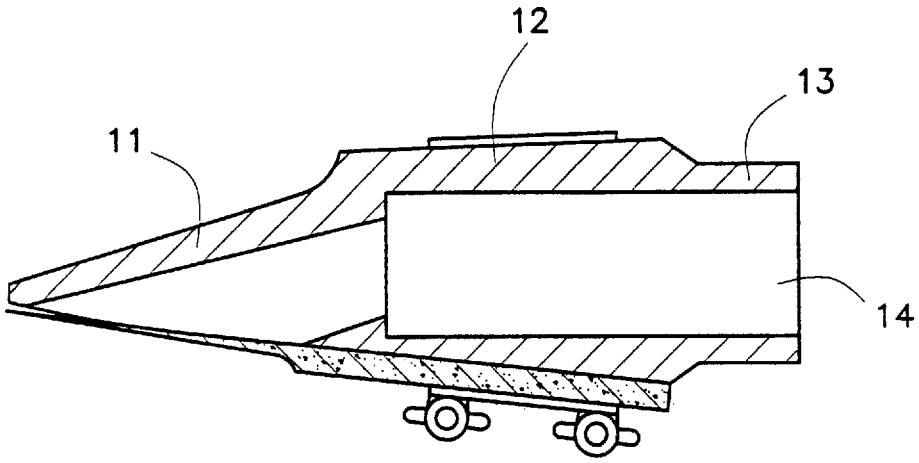
PRIOR ART FIG. 3
FIG. 3 is a side sectional view of the prior art.
Figure 4:
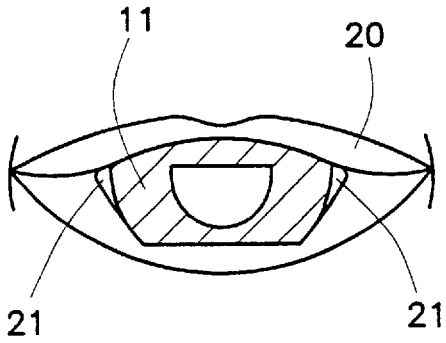
PRIOR ART FIG. 4
FIG. 4 is a view showing the prior art being held in the mouth of a player.
Figure 5:
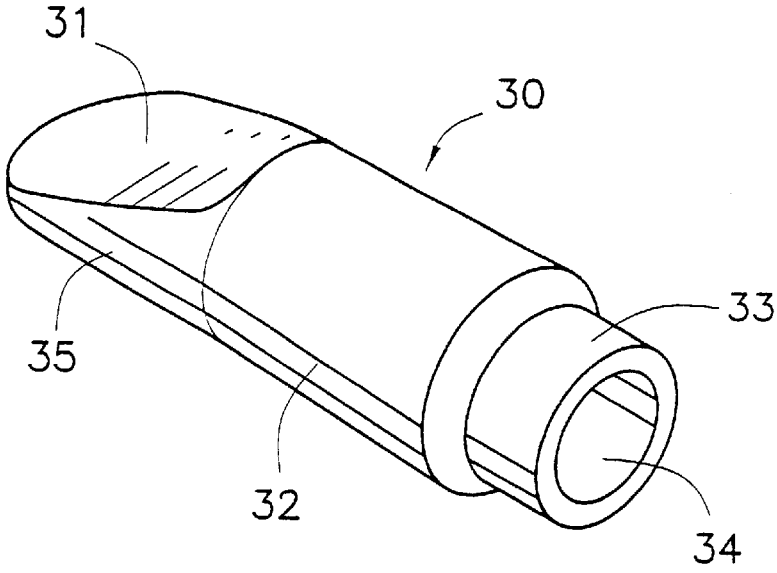
FIG. 5 is a perspective view of a preferred embodiment of the present invention.
Figure 6:
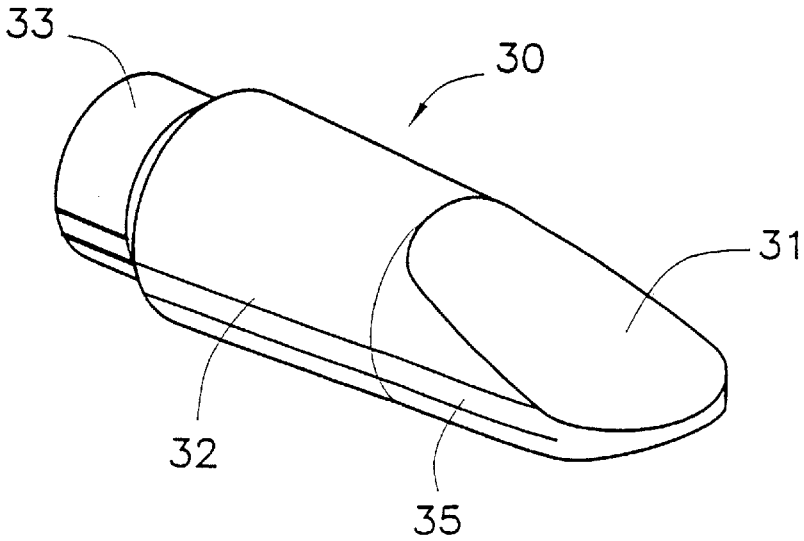
FIG. 6 is another perspective view of the preferred embodiment of the present invention.
Figure 7:
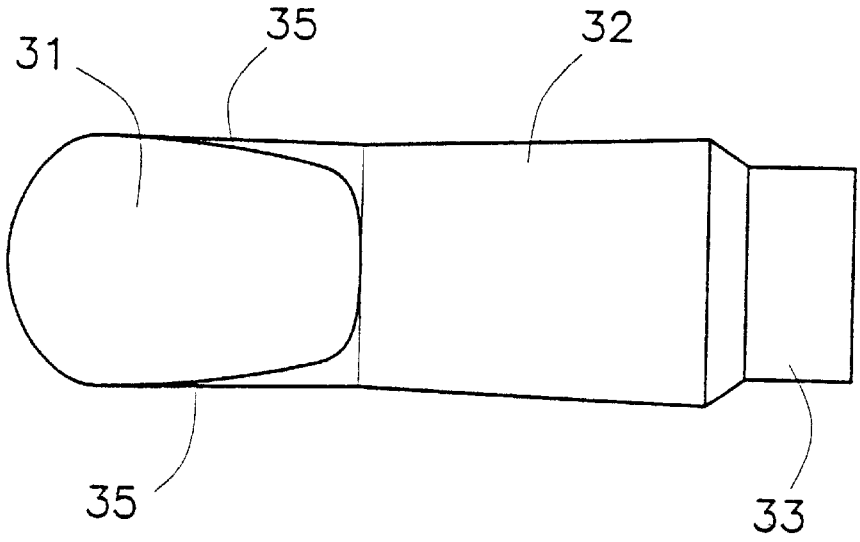
FIG. 7 is a top view of the preferred embodiment of the present invention.
Figure 8:
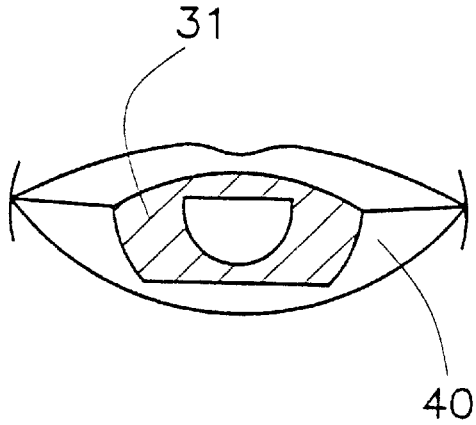
FIG. 8 is a schematic view showing the preferred embodiment of the present invention is held in a mouth of a player.

Referring to FIGS. 5 through 8, a preferred embodiment of the present invention related to an improved structure of a saxophone mouthpiece (30) is made in one piece, comprised of a reed (31), a middle section (32) and a tail (33). Wherein, the reed (31) indicates a mild slope rising in arc shape backwards to the middle section (32); the middle section (32) receiving the reed (31) has its outer circumference indicating mild conic shape; the tail (33) in a diameter smaller than that of the middle section (32) is adapted to a crook of the saxophone, and an air duct (34) penetrates inside the mouthpiece (30).

The present invention is characterized by that the reed (31) has a mild forward expansion respectively from both sides (35) at where it meets the middle section (32) so to allow easier and more concentrated playing of the saxophone by providing closer contact of two lips (40) of a player with both sides (35) of the reed (31) when the mouthpiece (30) is held in the mouth of the player.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of a saxophone mouthpiece, made in one piece, is comprised of a reed, a middle section, and a tail; the reed indicating a mild slope rising in arc backwards to the middle section; the middle section receiving the reed and having its outer circumference indicating an approximately conic shape; the tail in a diameter smaller than that of the middle section being adapted to a crook of the saxophone; and an air duct penetrating inside the mouthpiece characterized by that the reed having a mild expansion from both sides of the reed at where it meets the middle section to provide closer contact of lips of its player with both sides of the reed when the mouthpiece is held in the mouth of the player for allowing easier and more concentrated playing.

* * * * *